US009255485B2

(12) United States Patent
Watanabe et al.

(10) Patent No.: US 9,255,485 B2
(45) Date of Patent: Feb. 9, 2016

(54) TURBINE HOUSING MADE OF SHEET METAL

(75) Inventors: Daigo Watanabe, Tokyo (JP); Motoki Ebisu, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 988 days.

(21) Appl. No.: 13/384,958

(22) PCT Filed: Feb. 2, 2011

(86) PCT No.: PCT/JP2011/052104

§ 371 (c)(1),
(2), (4) Date: Feb. 9, 2012

(87) PCT Pub. No.: WO2012/105004

PCT Pub. Date: Aug. 9, 2012

(65) Prior Publication Data

US 2012/0251315 A1 Oct. 4, 2012

(51) Int. Cl.

| | |
|---|---|
| ***F04D 29/44*** | (2006.01) |
| ***F01D 9/02*** | (2006.01) |
| ***F01D 25/14*** | (2006.01) |

(52) U.S. Cl.

CPC ..... *F01D 9/026* (2013.01); *F01D 25/145* (2013.01); *F05D 2220/40* (2013.01)

(58) Field of Classification Search

CPC ..... F01D 9/026; F01D 25/14; F01D 25/145; F01D 25/24; F01D 29/44

USPC ..... 415/203, 204, 206, 214.1, 215.1

See application file for complete search history.

(56) References Cited

U.S. PATENT DOCUMENTS

| | | | | |
|---|---|---|---|---|
| 2003/0206798 | A1* | 11/2003 | Allmang et al. | 415/200 |
| 2009/0129920 | A1 | 5/2009 | Allport et al. | |

FOREIGN PATENT DOCUMENTS

| | | | |
|---|---|---|---|
| CN | 1573119 | A | 2/2005 |
| CN | 1834407 | A | 9/2006 |
| CN | 1952361 | A | 4/2007 |
| CN | 101952568 | A | 1/2011 |
| EP | 1 398 465 | A1 | 3/2004 |

(Continued)

OTHER PUBLICATIONS

International Preliminary Report on Patentability mailed on Aug. 15, 2013 issued in PCT/JP2011/052104 with an English translation.

(Continued)

*Primary Examiner* — Christopher Verdier
*Assistant Examiner* — Maxime Adjagbe
(74) *Attorney, Agent, or Firm* — Birch, Stewart, Kolasch & Birch, LLP

(57) ABSTRACT

In the neighborhood area X of the tongue part 27 forming the winding end part of the scroll part 3, the wall part members 31 are provided on both the sides of the welding part (the facing part) 'a' of the first scroll part 5 and the second scroll part 7, wherein: the wall part members 31 encloses the welding part (the facing part) 'a' and forms the gas-tight space 33; and, the outer circumference wall which enclose the facing part and forms a gas-tight space configure a double-wall structure.

4 Claims, 5 Drawing Sheets

(56) References Cited

FOREIGN PATENT DOCUMENTS

| | | | |
|---|---|---|---|
| JP | 62-90944 | U | 6/1987 |
| JP | 2002-194525 | A | 7/2002 |
| JP | 2002-349276 | A | 12/2002 |
| JP | 2003-293779 | A | 10/2003 |
| JP | 2003-536009 | A | 12/2003 |
| JP | 2006-161573 | A | 6/2006 |
| JP | 2006-161574 | A | 6/2006 |
| JP | 2007-2791 | A | 1/2007 |
| JP | 2007-278130 | A | 10/2007 |
| JP | 2008-57448 | A | 3/2008 |
| JP | 2009-203803 | A | 9/2009 |
| JP | 2009-544882 | A | 12/2009 |
| JP | 4485334 | B2 | 6/2010 |
| JP | 2010-168969 | A | 8/2010 |

OTHER PUBLICATIONS

Notice of Allowance issued Aug. 8, 2014 for corresponding Chinese Application No. 201180002462.1 with English translation.

Decision to Grant a Patent mailed Feb. 26, 2014 in corresponding Japanese Application No. 2013-087091 with an English translation.

Office Action from corresponding Japanese Application No. 2009-286316 mailed Feb. 7, 2013 with English Translation.

Office Action dated Dec. 25, 2013 issued in corrseponding Chinese Application No. 201180002462.1 with an English Translation.

Office Action dated Nov. 4, 2015 issued in the corresponding Chinese Application No. 201410189669.X with an English Translation.

* cited by examiner

TURBINE HOUSING MADE OF SHEET METAL

BACKGROUND OF THE INVENTION

1. Field of the Invention

The present invention relates to a turbine housing structure of a sheet metal structure, the turbine housing being used for a turbocharger which produces a turbocharged pressure for an engine by use of exhaust gas energy of the engine. The present invention especially relates to the turbine housing structure in which cracks and the like due to thermal stresses are prevented from occurring in a tongue part at a scroll winding end part.

2. Background of the Invention

Conventionally, turbochargers which enhance power output of an engine by supplying a pressurized air into the intake manifold of the engine by use of the exhaust gas energy discharged from the engine are known. When the turbocharger is mounted as a vehicle use, it is required to reduce the weight of the turbocharger especially in view of the tendency regarding fuel consumption improvement in recent years; thus, instead of the conventional turbine housing made by casting, turbine housings made of sheet metal have been used in recent years.

On the other hand, the turbine housing has the function of taking the engine exhaust gas in the housing and making the turbine rotor rotate. Consequently, the exhaust gas of the temperature level of 600 to 1050° C. streams into the turbine housing; a so-called tongue part, namely a gathering area of the gas flow inlet part of a circular shape in the turbine housing and the gas gathering part of the circulated gas flow end, is steeply heated up by the inlet gas flow and the gathering gas flow When the tongue part is steeply heated up, a force constraining a thermal elongation is generated by the temperature difference between the tongue part and a neighborhood area thereof. Hence, compression thermal stresses are generated. And, there arises a problem that the repeated thermal stresses cause cracks attributable to thermal stresses.

Also in a case of a turbine housing made of sheet metal, there has been a problem that the cracks due to the repeated thermal stresses attributable to the rapid heating of the tongue part are caused. Consequently, it is necessary to use sheet metal of even thickness; further, it is necessary to use sheet metal of thin thickness so that the thermal stress is reduced to the level free from the damage due to the inner pressure.

In addition, as a conventional technology in the related field, the structure of the turbine housing made of sheet metal has been proposed by Patent Reference 1 (JP2008-57448) or Patent Reference 2 (JP_P2003-536009). Further, Patent Reference 3 (JP2002-194525) proposes a structure of the tongue part whose thickness is increased by forming a thick plasma coating in comparison with the areas other than the tongue part, in order to enhance wear resistance property of the tongue part.

REFERENCES

Patent References

Patent Reference 1: JP2008-57448
Patent Reference 2: JP_P2003-536009
Patent Reference 3: JP2002-194525

SUMMARY OF THE INVENTION

Subjects to be Solved

However, as shown in FIG. 8, in the turbine housing made of sheet metal disclosed by Patent Reference 1, a scroll part 02 is formed so that sheet metal members 04 and 06 of the left and right sides are butt-joined and welded along a circumference direction. Thus, since the rapid heating and cooling of the tongue part as a winding end part of the scroll part 02 are repeated, the cracks of the tongue part may be easily caused, the cracks being attributable to not only the strength decrease due to the welding of the butt-joined sheet metal members but also the thermal stresses.

Further, also in the scroll structure disclosed by Patent Reference 2, the sheet metal members are butt-joined so as to form the scroll part; as explained in the case of Patent Reference 1, there is a problem that the cracks and the like of the tongue part are easily caused due to the thermal stresses. Further, Patent Reference 3 discloses the coating formation of the tongue part; however, Patent Reference 3 does not disclose a prevention measure against the occurrence of the cracks which are attributable to the strength decrease due to the rapid heating of the tongue part area as the winding end part of the scroll as well as due to the repetitions of the rapid heating.

In view of the problems as described above, the present invention aims at a turbine housing structure made of sheet metal. In the turbine housing structure, the subjects of the present invention are: preventing the occurrence of cracks in an area of the tongue part as the scroll winding end part, the cracks which are attributable to the thermal fatigue due to the repetitions of the rapid heating of the tongue part area as the winding end part of the scroll; and, reducing the weight of the structure, and enhancing the durability of the tongue part.

Means to Solve the Subjects

In order to solve the difficulties as described above, the present invention disclose a turbine housing made of sheet metal in which a scroll part forming a spiral exhaust gas passage is configured with scroll part members which are faced to and bonded to each other, the turbine housing including, but no limited to, a wall part member which is provided on each side of a facing part of the scroll part members, in a neighborhood area of a tongue part configuring the winding end part of the scroll part, wherein the wall part members which enclose the facing part and forms a gas-tight space configure a double-wall structure.

According to the present invention (the first disclosure) as described above, the exhaust gas streams into the turbine housing; a so-called tongue part, namely a gathering area of the gas flow inlet part of a circular shape in the turbine housing and the gas gathering part of the circulated gas flow end, is steeply heated up by the inlet gas flow and the gathering gas flow. Accordingly, heating and cooling are repeated; and, thermal stresses become high and thermal fatigue is caused. Hence, when the double-wall structure is applied to the concerned area, the functions against pressures as well as against thermal load can be divided by the double-wall structure.

As a result, the occurrence of cracks due to thermal stresses in the neighborhood of the tongue part can be prevented, and the safety and reliability of the turbine housing made of sheet metal can be enhanced.

In other words, when the double-wall structure is introduced, the sheet metal on the inner side along the inner side flow bears thermal loads; thus, even if cracks occur and the accompanied crack penetration is caused, the wall part member on the outer side withstands pressures so that the leakage of the inner side gas can be prevented.

Consequently, the occurrence of cracks in the neighborhood of the tongue part of the turbine housing made of sheet metal can be prevented. And, the safety and reliability of the turbine housing made of sheet metal can be enhanced.

A preferable embodiment of the present invention is the turbine housing made of sheet metal, wherein the wall part member is arranged on each side of a facing part of the scroll part members so that the wall part member connects an outer wall surface of the scroll part to an outer wall surface of a flow inlet part of the exhaust gas.

In other words, in a part of a hollow shape which is formed between the outer wall of the exhaust gas flow inlet part and the outer wall of the winding end part of the scroll part members, the wall part members may be formed, on both the sides of the scroll part members, so as to connect the outer wall of the exhaust gas flow inlet part to the outer wall of the winding end part of the scroll part members. In this way, by use of the wall part members, the double-wall structure can be easily provided at a confined area where the risk for crack penetration exists.

Another preferable embodiment of the present invention is the turbine housing made of sheet metal, wherein both the scroll part members facing each other are integrated into one body by weld-bonding the scroll part members along the whole circumference in the spiral direction of the scroll part.

Further, another preferable embodiment of the present invention is the turbine housing made of sheet metal, the facing part of both the scroll part members is not weld-bonded, the facing part being located inside of the space between the wall part members;

the other facing part of both the scroll part members is integrated into one-body by weld-bonding the other facing part along the whole circumference in the spiral direction of the scroll part.

As described above, in a case where the facing part of both the scroll part members is welded along the whole circumference in the spiral direction of the scroll part, the sealing effect against exhaust gas leakage is enhanced although the strength reduction is brought by the thermal stress which welding accompanies. On the other hand, in a case where the facing part inside of the enclosed space which is enclosed by the wall part members is not welded, the thermal stress which welding accompanies is not generated. Consequently, the strength reduction is prevented; further, the sealing function against the exhaust gas leakage is sufficiently achieved by the wall part members on the outer side.

Further, the present invention disclose at turbine housing made of sheet metal in which a scroll part forming a spiral exhaust gas passage is configured with scroll part members which face each other and are butt-jointed together, wherein:

the scroll part is formed so that both the scroll part members are integrated into one body by weld-bonding the scroll part members along the whole circumference in the spiral direction of the scroll part;

a welding-joint line is provided so as to depart from an area where a tongue part forming a winding-end part of the scroll part is formed in the turbine rotation axis direction in the neighborhood of the tongue part; and the tongue part is formed only with one of the scroll part members.

The welding part where the scroll part members are faced to and weld-bonded to each other is exposed to high thermal stresses due to welding. According to the above-described disclosure (the second disclosure), the welding-joint line is shifted apart from a location where the tongue part is formed in the turbine rotation axis direction; further, the tongue part is formed on only one of the scroll part members. Hence, the strength reduction due to thermal stresses in the area of the tongue part can be prevented. Further, the risk of the crack occurrence and the like in the neighborhood of the tongue part can be avoided. Thus, the safety and reliability of the turbine housing made of sheet metal can be enhanced.

Effects of the Invention

According to the first disclosure of the present invention, when the double-wall structure is applied to an area in the neighborhood of the tongue part, the functions against pressures as well as against thermal load can be separated in the neighborhood of the tongue part. The risk of the crack occurrence and the like due to thermal stresses and thermal fatigue in the neighborhood of the tongue part can be avoided.

Further, according to the second disclosure of the present invention, the welding-joint line is shifted apart from a location where the tongue part is formed in the turbine rotation axis direction; further, the tongue part is formed on only one of the scroll part members. Hence, the strength reduction due to thermal stresses in the area of the tongue part can be prevented. In addition, the risk of the crack occurrence and the like due to thermal stresses and thermal fatigue in the neighborhood of the tongue part can be avoided.

As described above, according to the first and second disclosures, the risk of the crack occurrence and the like due to thermal stresses in the neighborhood of the tongue part can be avoided. Thus, the safety and reliability of the turbine housing made of sheet metal can be enhanced.

DETAILED DESCRIPTION OF THE PREFERRED MODES AND EMBODIMENTS

Hereafter, the present invention will be described in detail with reference to the modes or embodiments shown in the figures. However, the dimensions, materials, shape, the relative placement and so on of a component described in these modes or embodiments shall not be construed as limiting the scope of the invention thereto, unless especially specific mention is made.

(First Mode)

Based on FIGS. 1 to 5, a turbine housing made of sheet material according to a first mode of the present invention is now explained.

Figure 1:
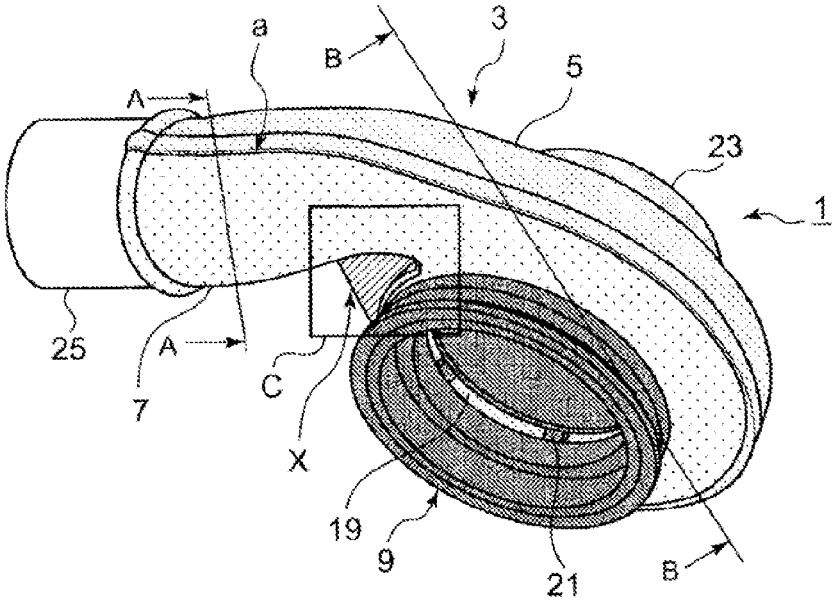
FIG. 1 shows a configuration-outline bird view of a turbine housing made of sheet metal according to a first mode of the present invention.
Figure 2:
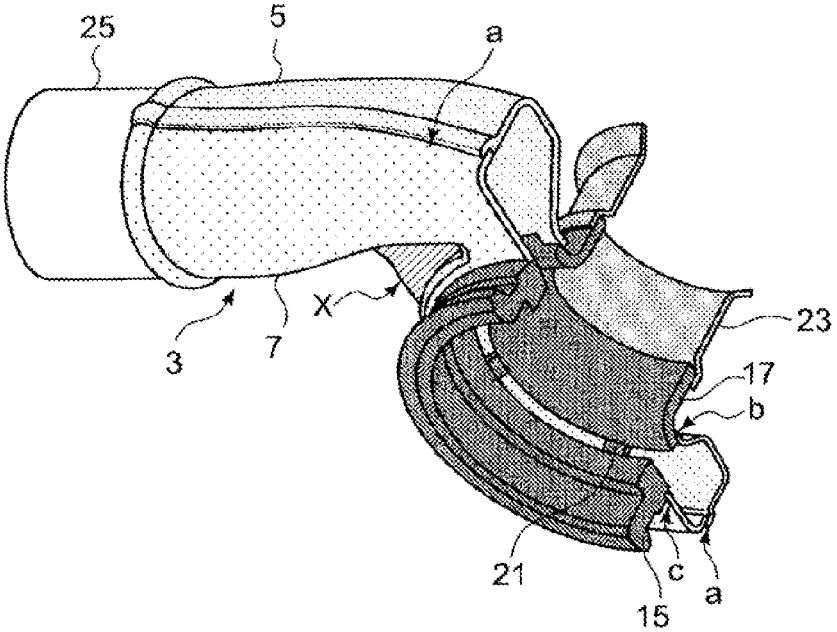
FIG. 2 shows the major configuration along a B-B cross-section in a bird view, the B-B line being described in FIG. 1.

As shown in FIGS. 1 and 2, the turbine housing 1 made of sheet material mainly includes, but not limited to, a scroll part 3, a center core part 9 and the outlet pipe part 23. Further, the scroll part 3 includes, but not limited to, a first scroll part 5 and a second scroll part 7, the scroll parts 5 and 7 facing each other. Weld-bonding the four members forms the turbine casing 1.

Figure 3:
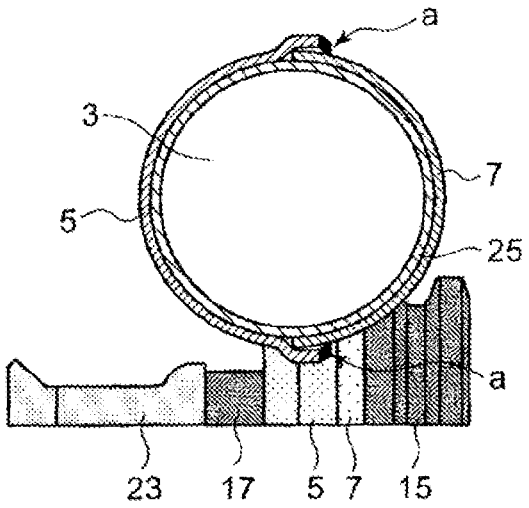
FIG. 3 shows the major configuration in an A-A cross-section in FIG. 1.

The scroll part 3 forming a spiral gas passage is configured by butt-joining the first scroll part 5 and the second scroll part 7 as well as by weld-bonding the butt-joined parts. Thus, the gas passage is formed. As shown in FIG. 3, at the location of the A-A cross section, each of the scroll parts 5 and 7 has a cross section of an almost semicircular shape.

At a circular center part of the scroll part 3, the center core part 9 is provided, the center core part 9 as a whole almost forming a cylindrical shape. And, the center core part 9 includes, but not limited to: a bearing housing part 15 in which a bearing supporting a rotation shaft of the turbine rotor 13 (cf. FIGS. 5 and 6) is arranged; and, a flow passage outlet part 17 which forms a gas passage on the discharged side. Between the bearing housing part 15 and the flow passage outlet part 17, a plurality of columns 21 is provided.

The columns 21 provide a flow passage 19 through which the gas streaming along the spiral direction in the scroll part 3 can smoothly stream toward the center side; further, in order to connect the bearing housing part 15 to the flow passage outlet part 17, multiple columns 21 are arranged at predetermined locations in a hoop direction around the turbine rotor with a distance between columns. Thus, bearing housing part 15 and the flow passage outlet part 17 are connected to each other via the columns, and integrated into one body.

Further, the columns 21 may be evenly or unevenly spaced in the hoop direction. And, the cross section profile of the column 21 almost forms a quadrilateral; however, the cross section profile may form a triangle so that the profile has a tapered surface along the gas flow direction in order to prevent the column from being of resistance against the gas flow as well as in order to make the gas flow stream toward the central side. Or, the cross section profile may form a streamlined profile, although the cutting processes in machining become complicated.

Further, the columns 21 connect the bearing housing part 15 to the flow passage outlet part 17; and, the columns is made of a material having strength and heat resistance properties so that a gap space distance between the turbine rotor 13 and the center core part 9 is maintained constant even when temperatures become high or external forces appear.

In addition, an outlet pipe part 23 of a pipe shape is jointed to a tip end side of the flow passage outlet part 17 by means of welding around all the circumference of the jointing part.

The first scroll part 5 and the second scroll part 7 are formed with a thin plate (whose thickness is about 1 to 3 mm) of sheet metal material; and, butt-joining the end sides of the parts 5 and 7 forms a spiral gas passage. As shown in FIG. 3, the tip end of the part 5 is superposed on the tip end of the part 7; and, a welding part 'a' is formed. Along the welding part 'a,' a one-side fillet welding is performed from outside along the superposed part, namely along the whole circumference in the spiral direction of the scroll part 3.

In addition, instead of the one-side fillet welding, both the scroll parts may be welded by butt-welding in a manner that tip end sides of sheet metal members are butted and welding is performed along the butted part. Further, the sheet metal may be configured with a heat-resisting steel such as an austenite steel and a stainless steel.

Further, the end part (of the first scroll part 5) on the center core 9 side of the first scroll part 5 is weld-bonded to the bearing housing part 15 along the outer circumference of the bearing housing part 15; and, the end part (of the second scroll part 7) on the center core 9 side of the second scroll part 7 is weld-bonded to the bearing housing part 15 along the outer circumference of the flow passage outlet part 17. A welding part 'b' is formed along the outer circumference of the flow passage outlet part 17. And, a welding part 'c' is formed along the outer circumference of the bearing housing part 15.

Further, the bearing housing part 15, the flow passage outlet part 17 and the columns 21 connecting the parts 15 and 17 are integrated into one-piece. Accordingly, the integrated part formed by the bearing housing part 15, the flow passage outlet part 17 and the columns 21 is manufactured via cutting processes of machining of metals. Similarly, the outlet pipe part 23 is manufactured via cutting processes of machining of metals.

The exhaust gas enters from an inlet pipe part 25 (cf. FIGS. 1 and 2), streams and circulates along a gas flow passage in the scroll part 3 toward a gas inlet part of the scroll part 3, and joins the exhaust gas entering the gas inlet part. The neighborhood area of a tongue part 27 which configures a winding end part of the scroll part 3 is steeply heated up. When the tongue part 27 is steeply heated up, a force constraining a thermal elongation is generated by the temperature difference between the tongue part 27 and the neighborhood area. Hence, thermal compression-stresses are generated. And, the repeated thermal stresses cause cracks which is attributable to the thermal stresses.

The occurrence of the cracks attributable to the thermal stresses in the neighborhood of the tongue part 27 is not limited to the turbine housing of the sheet metal structure according to the present invention. The cracks occur also in a case of the conventional turbine housing of a casting type. This has been confirmed by numerical analyses, experiments and the like.

Figure 5:
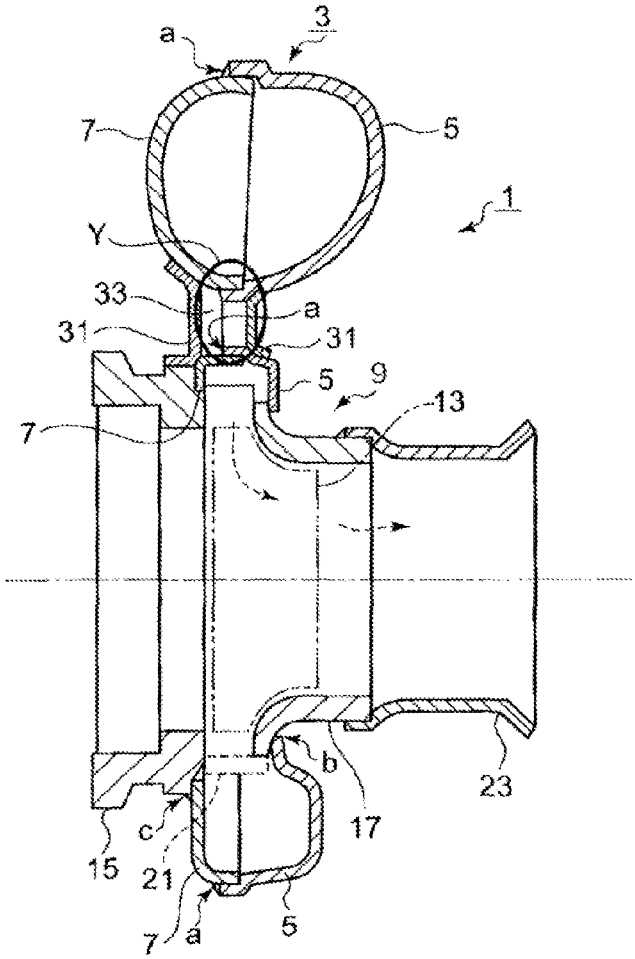
FIG. 5 shows the major configuration in a D-D cross-section in FIG. 4.

In order to prevent the occurrence of the cracks due to the thermal stresses in the neighborhood of the tongue part 27, in the present invention, a wall part member 31 is provided on both sides of the welding part 'a', as shown in FIG. 5.

In other words, the wall part member 31 is formed between an outer wall of the winding end part of the scroll part 3 and an outer wall of the first scroll part 5 extending from the gas flow inlet part to the tongue part 27; similarly, the wall part member 31 is formed between an outer wall of the winding end part of the scroll part 3 and an outer wall of the second scroll part 7 extending from the gas flow inlet part to the tongue part 27. Further, an upper end of the wall part member 31 (on the first scroll part side) is weld-bonded to the outer wall of the first scroll part 5; and, an upper end of the wall part member 31 (on the second scroll part side) is weld-bonded to the outer wall of the second scroll part 7. And, a lower end of the wall part member 31 (on the first scroll part side) is weld-bonded to the outer wall of the winding end part of the scroll part 3; and, a lower end of the wall part member 31 (on the second scroll part side) is weld-bonded to the outer wall of the winding end part of the scroll part 3. Further, the front ends of both the wall part members 31,31 are closed so that the superposed part of the first scroll part 5 and the second scroll part 7 is enclosed and an enclosed space 33 is formed.

Figure 4:
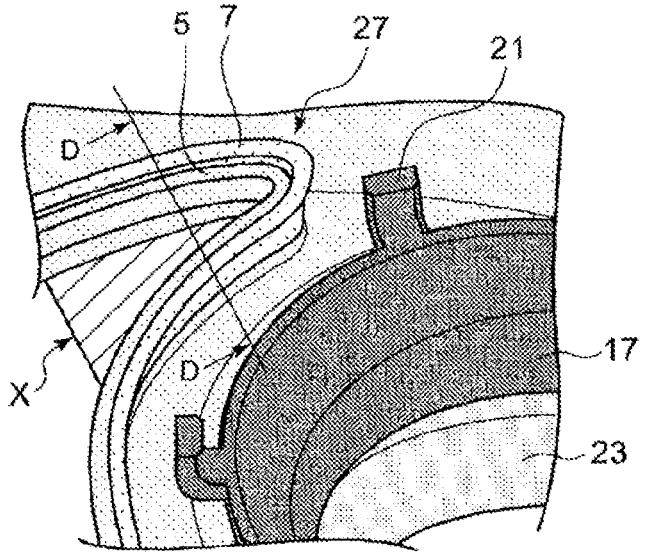
FIG. 4 shows an enlargement of the part C in FIG. 1.

The range in which the wall part members 31 are provided is formed in the neighborhood of a tongue part area as described by the area X in FIG. 4. This neighborhood of tongue part is an area of a hollow shape which is formed between the outer wall of the winding end part of the scroll 3 and the outer walls of the first scroll part 5 and the second scroll part 7, the outer walls of the first and second scroll parts extending from the gas flow inlet part to the tongue part 27. The tongue part 27 is formed inside of the first scroll part 5 and the second scroll part 7, each of the scroll parts 5 and 7 forming the bottom part of the hollow part (cf. FIG. 4).

In this way, by use of the wall part members 31, a double-wall structure can be easily arranged in a certain limited area as a tongue part neighborhood area X where there is a concern about the risk of crack penetration.

Further, the butt-joined part of the first scroll part 5 and the second scroll part 7 may be only superposed without performing welding, the butt-joined part of the parts 5 and 7 being located between the wall part members 31 on both the sides. When the butt-joined part inside of the enclosed space 33 which is enclosed by the wall part members 31 is welded along the whole circumference in the circulating direction of the scroll part 3, the sealing effect against exhaust gas leakage is enhanced although the strength reduction is brought by the thermal stress which welding accompanies. When the butt-joined part inside of the enclosed space 33 which is enclosed by the wall part members 31 is not welded, the thermal stress which welding accompanies is not generated. Consequently, the strength reduction is prevented; further, the sealing function against the exhaust gas leakage is achieved by the wall part members 31 provide outside of the butt-joined part.

According to the present invention as described above, by forming a double-wall structure provided with: a wall structure which is formed by butt-joining the first scroll part 5 and the second scroll part 7; and a wall structure which is formed by the wall part members 31 outside of the butt-joined part, the first scroll part 5 and the second scroll part 7 which are arranged along the internal flow as well as on the inner side can bear the thermal stresses. And, even if cracks or penetration appears, the internal gas leakage can be prevented by the wall part members 31 which withstand the internal gas pressure.

As a result, the occurrence of cracks such as causes the gas leakage in the neighborhood of the tongue part 27 of the turbine housing 1 made of sheet metal can be prevented. Thus, the safety and reliability of the turbine housing made of sheet metal can be enhanced.

(Second Mode)

Figure 6:
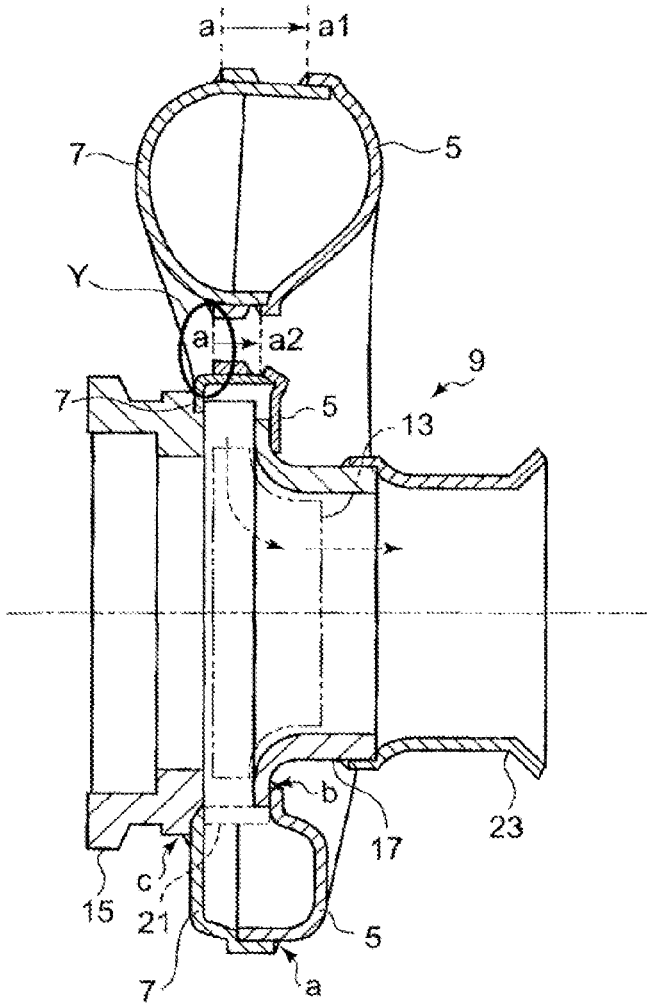
FIG. 6 explains a second mode of the present invention in a cross section corresponding to FIG. 5.
Figure 7:
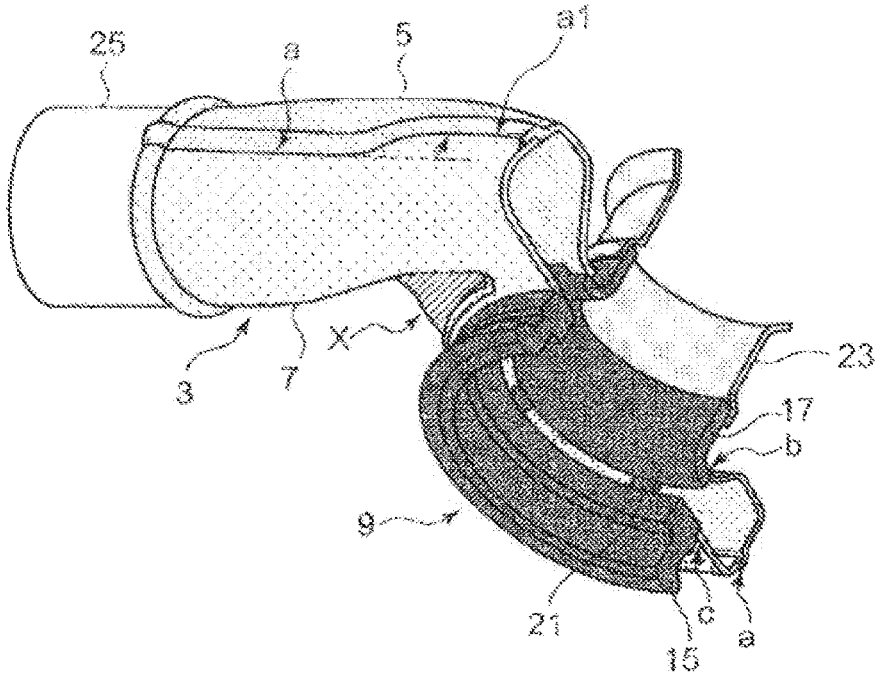
FIG. 7 explains the major configuration of the second mode of the present invention in a bird view corresponding to FIG. 2.
Figure 8:
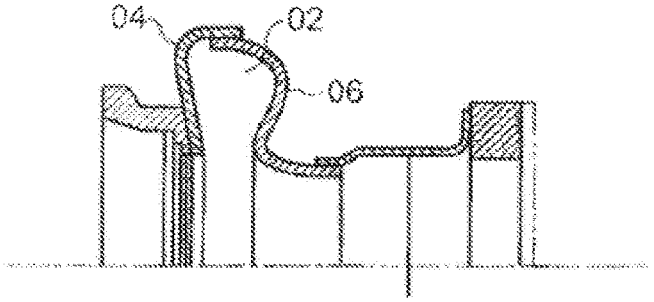
Fig. 8 PRIOR ART
FIG. 8 explains a conventional technology.

In the next place, based on FIGS. 6 and 7, a second mode of the present invention is now explained. FIG. 6 corresponds to FIG. 5. And, FIG. 6 shows the whole cross section along the D-D line cut of FIG. 4. In the area X in the neighborhood of the tongue part, a line of the welding part 'a' along which the butt-joined part of the first scroll part 5 and the second scroll part 7 is welded is provided so that the line of the welding part 'a' departs from and detours around a location where the tongue part 27 is formed in the turbine rotation axis direction. The line of the welding part 'a' on the outer circumference side of the scroll part 3 is shifted to the locational; the line of the welding part 'a' on the tongue side is shifted to the location a2. In this way, the lines of welding parts are provided.

Further, at a tongue part forming area Y where the tongue part 27 is formed, the facing part of the first scroll part 5 and the second scroll part 7 does not exist; and the welding part 'a' is shifted toward the outside of the tongue part forming area Y (outside in the turbine rotation axis direction). By the configuration as described, only the member of the first scroll part 5 exists in the tongue part forming area Y.

Incidentally, as shown in FIGS. 5 and 6, the tongue part forming area Y is an area where a gas flow passage in a radial direction is formed from the scroll part 3 to the turbine rotor 3.

In FIG. 7, the major configuration of the second mode is shown in a bird view which corresponds to the bird view of FIG. 2. And, FIG. 7 shows the situation in which the line of the welding part 'a' of the scroll part 3 in the tongue part forming area X is shifted to the locational. As is the case with the change of the location of the welding part 'a' into the locational, the location of the welding part 'a' on the tongue part side is changed into the location a2 (not shown).

The possibility of the occurrence of cracks in the facing and weld-bonding part of the first scroll part 5 and the second scroll part 7 is high, the cracks being caused by the thermal fatigue attributable to high thermal stresses due to welding. According to the second mode, the welding-joint line is shifted apart from a location where the tongue part is formed; and, in the area of the tongue part 27, only one of the first scroll part 5 and the second scroll part 7 exist, the scroll parts 5 and 7 facing each other and being butt-joined together. Hence, the occurrence of thermal stresses in the tongue area can be avoided, the thermal stresses being attributable to welding. Further, the low cycle fatigue strength can be enhanced.

Consequently, the risk of crack occurrence and the like due to thermal stresses and thermal fatigue in the tongue part 27 as well as in the neighborhood of the tongue part can be avoided. Hence, the safety and reliability of the turbine housing made of sheet metal can be enhanced.

Industrial Applicability

According to the present invention, the turbine housing structure made of sheet metal can be provided, wherein the crack occurrence and the like due to the thermal fatigue caused by rapid heating repetitions in the area of the tongue part as the scroll winding end part is prevented; and, the weight reduction can be achieved and the durability of the tongue part can be enhanced. Thus, the present invention is suitably applicable to a turbine housing made of sheet metal.

The invention claimed is:

1. A turbine housing made of sheet metal comprising:

a scroll part forming a spiral exhaust gas passage, the scroll part including a first scroll member and a second scroll member which faces and is bounded to the first scroll member, the first scroll member and the second scroll member being made of sheet metal;

a first wall part member which is arranged on one side of a facing part of the first scroll member and the second scroll member, in a neighborhood area of a tongue part configuring a winding end part of the scroll part, so that the first wall part member connects an outer wall surface of the scroll part to an outer wall surface of a flow inlet part of exhaust gas, the first wall part member is a separate part from the first scroll member and the second scroll member; and a second wall part member which is arranged on another side of the facing part of the first scroll member and the second scroll member, in neighborhood area of the tongue part configuring the winding end part of the scroll part, so that the second wall part member connects the outer wall surface of the winding end part of the scroll part to the outer wall surface of the flow inlet part of the exhaust gas of the scroll part, the second wall part member is a separate part from the first scroll member and the second scroll member, wherein upper ends of the first wall part member and the second wall part member connect to the outer wall surfaces of the winding end part of the scroll part;

lower ends of the first wall part member and the second wall part member connect to the outer wall surfaces of the flow inlet part of the scroll part; and front ends between the upper ends and the lower ends of both the first wall part member and the second wall part member are closed so as to enclose the facing part and form a gas-tight space closed to gas flow through the gas-tight space.

2. The turbine housing made of sheet metal according to claim 1, wherein both the first scroll member and the second scroll member are integrated into one body by weld-bonding along the whole circumference in the spiral direction of the scroll part.

3. The turbine housing made of sheet metal according to claim 1, wherein the facing part of both the first scroll member and the second scroll member is not weld-bonded, the facing part being located inside of a space between the first wall part member and the second wall part member;

an other facing part of both the first wall part member and the second wall part member is integrated into one-body by weld-bonding the other facing part along the whole circumference in the spiral direction of the scroll part.

4. A turbine housing made of sheet metal comprising:

a scroll part forming a spiral exhaust passage, the scroll part being configured with scroll part members which face each other and are butt-joined together, the scroll members being made of sheet metal, wherein:

the scroll part is formed so that both the scroll part members are integrated into one body by weld-bonding the scroll part members along the whole circumference in the spiral direction of the scroll part;

a welding-joint line is provided so as to depart from an area where a tongue part forming a winding-end part of the scroll part is formed in the turbine rotation axis direction in the neighborhood of the tongue part; and the tongue part is formed only with one of the scroll part members.

* * * * *